US005114256A

United States Patent [19]

Lin

[11] Patent Number: 5,114,256

[45] Date of Patent: May 19, 1992

[54] CLEANING BRUSH

[75] Inventor: Shih C. Lin, Ping Tung Hsien, Taiwan

[73] Assignee: Halcyon Corporation, Ping Tung Hsien, Taiwan

[21] Appl. No.: 643,743

[22] Filed: Jan. 22, 1991

[51] Int. Cl.[5] ..... A46B 11/06

[52] U.S. Cl. ..... 401/46; 401/272; 401/273; 401/289

[58] Field of Search ..... 401/270, 272, 273, 40–47, 401/289, 272, 273, 278

[56] References Cited

U.S. PATENT DOCUMENTS 1,115,370 10/1914 Allen et al. ..... 401/273 X
1,445,976 2/1923 Sealund ..... 401/273
2,738,111 3/1956 Wright ..... 401/273 X
3,405,997 10/1968 Diebold ..... 401/46
4,826,340 5/1989 Rothweiler et al. ..... 401/270 X

FOREIGN PATENT DOCUMENTS 46116 1/1911 Austria ..... 401/273
373513 5/1932 United Kingdom ..... 401/273

*Primary Examiner*—Steven A. Bratlie
*Attorney, Agent, or Firm*—Fitch, Even, Tabin & Flannery

[57] ABSTRACT

A cleaning brush has a bristle plate and a chamber for a cleaning solution provided with an inlet and a plurality of outlets. The bristle plate has a plurality of countersinks corresponding to the outlets of the chamber; a corresponding number of valves are provided between a bottom of the chamber and the bristle plate to control a flow of a solution by way of depressing the bristle plate.

1 Claim, 4 Drawing Sheets

CLEANING BRUSH

BACKGROUND OF THE INVENTION

This invention relates to a cleaning brush formed with a chamber for containing a cleaning solution and a valve urged by a bristle plate for controlling a flow of the solution.

Typically, a cleaning brush and a cleaning solution are used for cleaning. For convenience, a cleaning brush is equipped with a chamber for containing a cleaning solution, such as a detergent solution, when in use. Conventionally, such a cleaning brush merely provides a hole on a bottom of the chamber, and further provides a manual valve to control a flow of the solution. In operation, the valve is switched, thereby allowing the solution to flow out by gravity. When the operation is completed, a user has to switch the valve back, thereby preventing the solution from continuously flowing out. This is inconvenient, and the solution will leak out if the user forgets to switch the valve back.

Furthermore, such a cleaning brush usually uses an innerly threaded flap to seal an inlet of the chamber; the user has to screw out the flap to replenish the chamber with solution, providing further inconvenience for the user. While the flap is put aside for replenishment, the flap is easily lost by the user's inadvertence.

It is the purpose of this present invention, therefore, to mitigate and/or obviate the above-mentioned drawbacks in the manner set forth in the detailed description of the preferred embodiment.

SUMMARY OF THE INVENTION

The present invention provides a cleaning brush which comprises a brush body defining a chamber including a plurality of outlets, a tubular handle, a bristle plate including a plurality of countersinks each corresponding to an outlet of the chamber, and a plurality of valves each corresponding to a hole of the bristle plate.

The tubular handle is integrated with the brush body and communicates with a water pipe for supplying water.

The brush body includes a chamber for containing a solution, such as a detergent solution, and a skirt extending around and below the chamber, thereby defining an opening. The chamber has an inlet with a rubber ring and a plurality of countersink outlets and a flap pivotally mounted on the brush body for sealing the inlet.

The bristle plate has a plurality of countersinks corresponding to the outlets for draining the solution. Furthermore, each countersink has at least one longitudinal rib fixed therein.

A valve is deposited upon the countersink and comprises a valve plunger integrated with a valve head compatible with the countersink outlet for sealing the countersink outlet. A washer engaging with the plunger cooperates with a spring to keep the valve in a sealing position when the valve and the bristle plate are not urged up.

Accordingly, it is an object of this invention to provide a cleaning brush with a chamber including an inlet and at least one outlet which can be opened and closed easily.

A further object of this invention is to provide a cleaning brush with a chamber including an inlet and at least one outlet and a flap to seal the inlet of the chamber.

DETAILED DESCRIPTION OF THE PREFERRED EMBODIMENT

Figure 1:
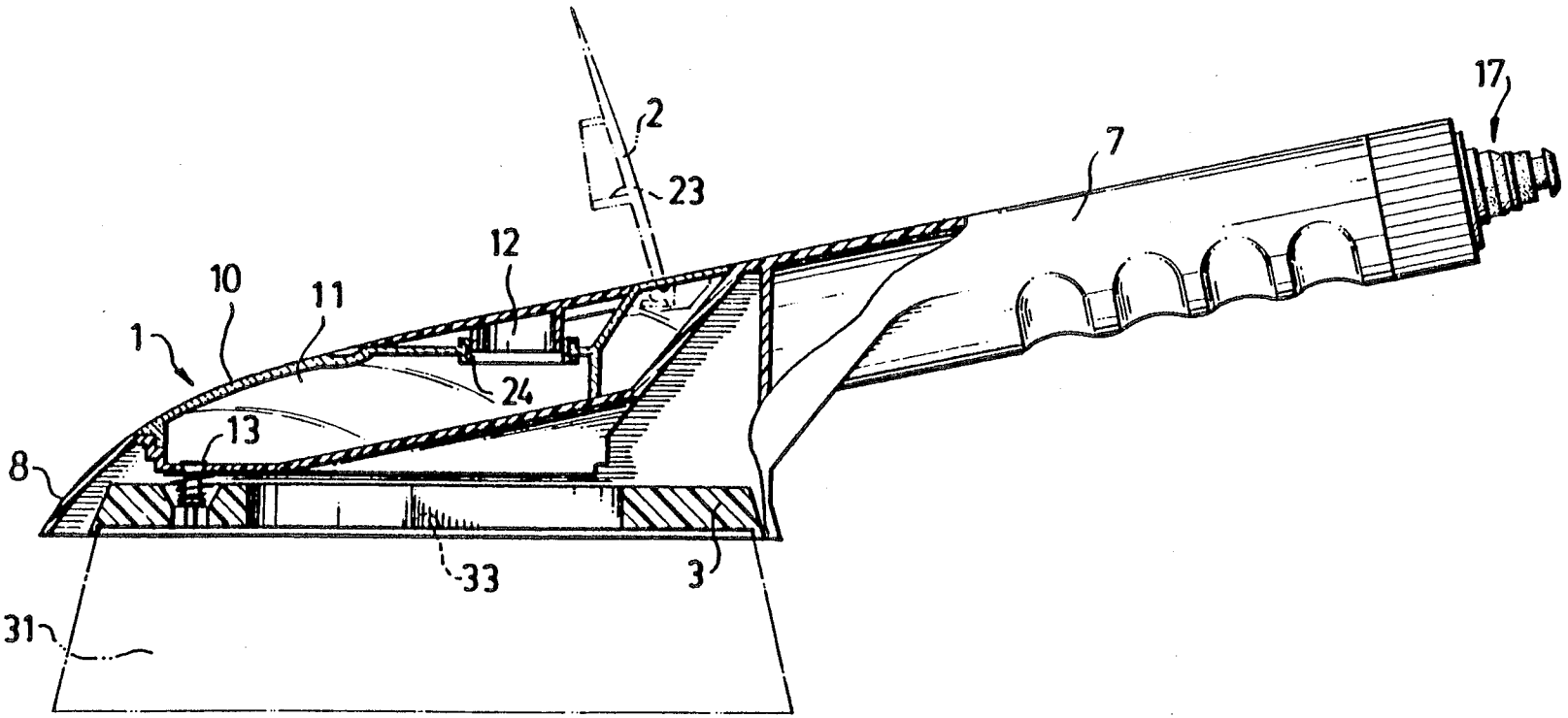
FIG. 1 is a partially cross-sectional view of a cleaning brush in accordance with the present invention.

Referring to FIG. 1, which shows a cleaning brush in accordance with the present invention, the cleaning brush 1 comprises a brush body 10 and a tubular handle 7. The tubular handle 7 is integrated and communicates with the brush body 10 and has a coupling means 17 at an end thereof to communicate with a water tube communicating with a water supply.

The brush body 10 has a chamber 11 in an upper portion thereof. The chamber 11 has an inlet 12, a plurality of outlets 13, and a flap 2 which is pivotally mounted on the brush body 10 to cover the inlet 12. Also, at a bottom of the brush body 10, there is provided a skirt 8 extending therearound, thereby defining an opening to receive a bristle plate 3.

Figure 2:
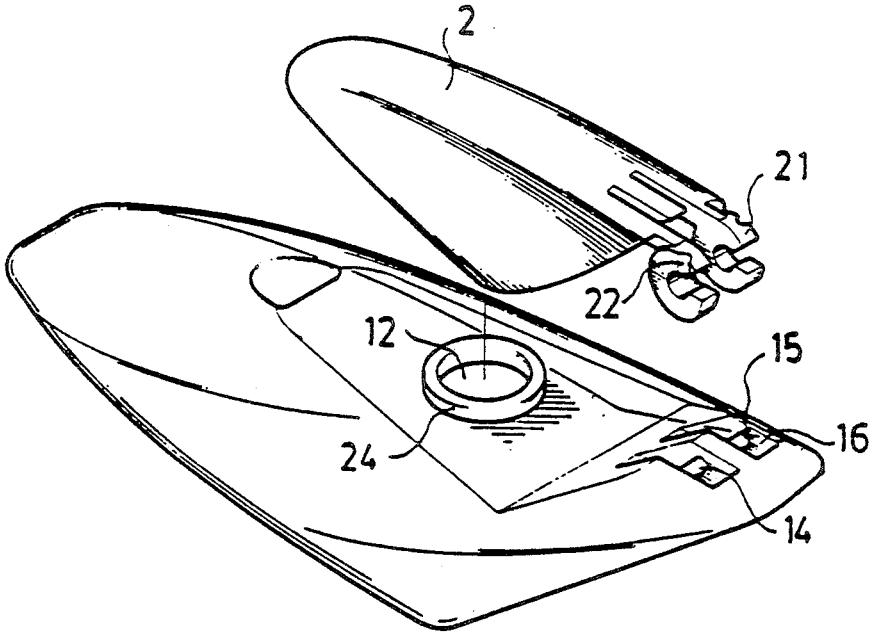
FIG. 2 is an exploded view of a chamber of the cleaning brush.

Referring to FIG. 2, which shows an enlarged chamber 11 and a flap 2, the chamber 11 is provided with two slots 16 at an upper rear outside portion of its wall with a pin 14 crossing the slots 16 as a pivotal axle. Additionally, there is provided a projection 15 on an outer wall of each slot 16. The flap 2 has an end integrated with two backward-resilient C-shaped engaging clips 21, each providing a recess 22 corresponding to the projection 15, such that the flap 2 is pivotally mounted on the brush body 10 by engaging the C-shaped clips 21 with the pins 14. Furthermore, while the flap 2 is in a closing position, the recesses 22 may engage with the projections 15 to prevent the flap 2 from pivotally rotating.

A circular protuberant flange 23 is integrated on an under surface of the flap 2 (shown in FIG. 1). The inlet 12 has a peripheral flange 24 affixed with a rubber ring. When the flap 2 is in the closed position, the protuberant flange 23 fits within the flange 24, thereby sealing the inlet 12.

Figure 4:
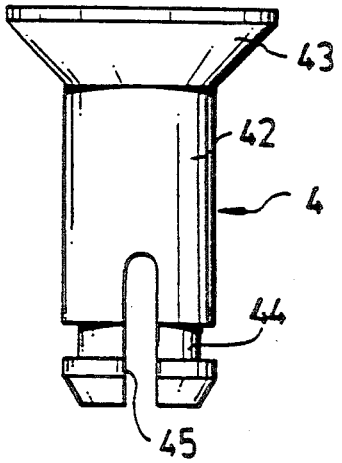
FIG. 4 is a lateral view of a valve plunger.
Figure 6:
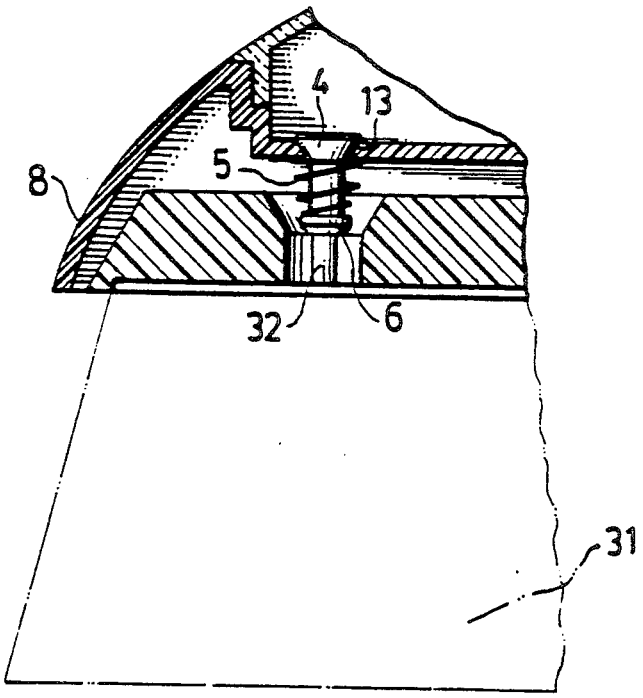
FIG. 6 is a view similar to FIG. 5, wherein the valve seals an outlet of the chamber.

The chamber 11 has a plurality of countersink outlets 13; each countersink outlet 13 cooperates with a valve 4, as shown in FIGS. 4 and 6. The valve 4 comprises a valve plunger 42 including a first end and a second tapered end, a valve head 43 being integrated with the first end of the valve plunger 42 and compatible with the countersink outlet 13, and an annular groove 44 being defined adjacent to the second tapered end of the valve plunger 42. The second tapered end of the plunger 42 and the annular groove 44 are both divided into four parts by two longitudinal slots 45. Thus, the plunger 42 can be inserted from the chamber 11 through the countersink outlet 13 into the opening defined by the skirt 8, such that the valve head 43 matches with the outlet countersink 13, thereby sealing the countersink outlet 13. A spring 5 encases the valve plunger 42, with a top end contacting a bottom of the chamber 11 and a bottom end contacting a washer 6 engaging with the annular groove 44, thereby providing a constant expansion force to urge the valve 4 in a sealing position.

Figure 3:
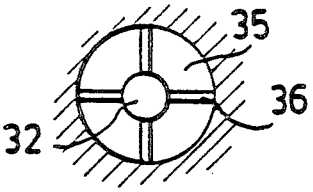
FIG. 3 is a bottom view of a countersink hole of a bristle plate.
Figure 5:
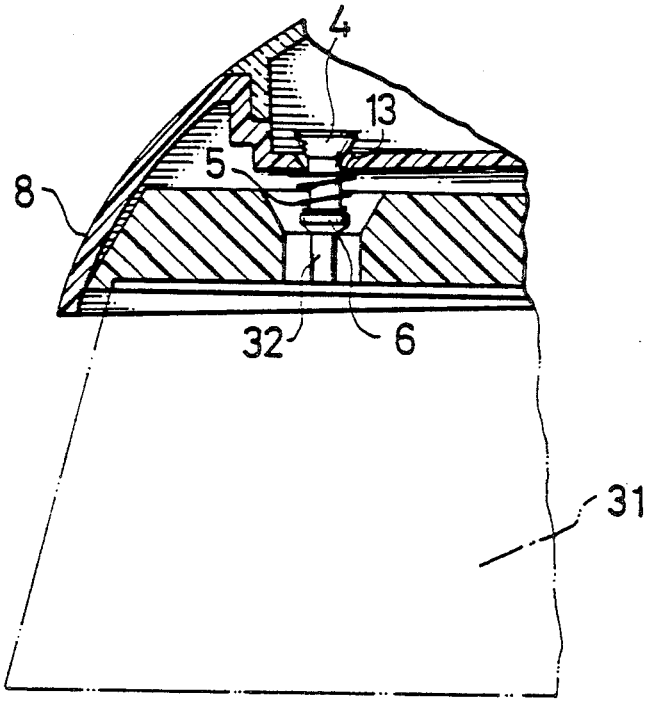
FIG. 5 is a partial cross-sectional view of the cleaning brush, showing a valve being urged up by a bristle plate.

Referring back to FIG. 1, the brush body 10 has a skirt portion 8 extending around a bottom thereof, thereby defining an opening. The skirt portion 8 has an inward projection on a middle of each lateral edge thereof. A bristle plate 3 is shaped so as to fit in the opening defined by the skirt portion 8, and has an opening 33 at each lateral side thereof corresponding to the projection on the lateral edge of the skirt portion 8. Thus, the bristle plate 3 may be received in the opening defined by the brush body 10 by buckling the opening 33 to the projection of the skirt portion 8 and pivotally rotating about an axis of the projection of the skirt portion 8. The bristle plate 3 further has a plurality of countersinks 35, each corresponding to one of the outlets 13 of the chamber 11, with reference to FIGS. 3 and 5; each countersink 35 has a plurality of ribs 36 being integrated with a central pin 32. When the brush is pressed and moved for cleaning, the bristle plate 3 may be urged into the brush body 10, thereby urging the valve plunger 42 of the valve 4 upward by means of the central pin 32 and ribs 36. It is preferable that a diameter of the countersink is larger than that of the washer 6, so that cleaning solution may flow through the outlet 13 and the countersink 35 to the bristles 31.

When pressure on the bristle plate 3 is removed, the valve head 43 is urged downward by the spring 5 to seal the outlet 13.

When the brush is pressed downward, the bristle plate 3 will be stressed into the brush body 10, preventing the bristle plate 3 from compressing the chamber 11 and thereby elongating the life of the chamber 11. Also, the skirt portion provides a slanted inner wall in a front and rear portion thereof to block movement of the bristle plate 3.

Many variations of the present invention within the scope of the appended claims will be apparent to those skilled in the art once the principles described herein are understood.

I claim:

1. A cleaning brush comprising:

a body;

tubular means integrated with said body for connection to a water source;

an enclosed chamber for a cleaning solution in the body independent of said tubular means and provided with a single inlet and at least one countersink outlet;

a flap pivotally mounted on the outside of said body and integrated with a plug for sealing said inlet;

a skirt extending around a bottom of said body, thereby defining an opening in the body;

at least one valve complementary in form to said at least one countersink outlet and including a head, being compatible with said at least one countersink outlet, including a first condition sealing said countersink outlet and a second condition allowing a solution to drain out of said chamber through said countersink outlet, a plunger including a first end integrated with said head and a second end formed with an annular groove, projecting through said countersink outlet, a washer received in said groove, and a spring adjacent said plunger and including a first end abutting a bottom wall of said chamber and a second end abutting said washer, thereby urging said valve head in said first condition; and a bristle plate retained within said opening and including at least one countersink aligning with said at least one valve and including at least one rib, said plunger abutting said rib so that said valve is urged away from said countersink outlet when said bristle plate is urged toward said chamber, thereby rendering said head in said second condition.

* * * * *